United States Patent [19]

Tanaka

[11] Patent Number: 4,797,935

[45] Date of Patent: Jan. 10, 1989

[54] SPEAKER SYSTEM WITH INDEPENDENTLY SUPPORTED TOP PLATE

[75] Inventor: Fujio Tanaka, Saitama, Japan

[73] Assignee: Pioneer Electronic Corporation, Tokyo, Japan

[21] Appl. No.: 17,406

[22] Filed: Feb. 24, 1987

[30] Foreign Application Priority Data

Feb. 24, 1986 [JP] Japan ..... 61-24502[U]

[51] Int. Cl.[4] ..... H04R 1/02

[52] U.S. Cl. ..... 381/205; 381/158; 381/188; 181/171

[58] Field of Search ..... 381/158, 159, 188, 205, 381/90, 88; 181/171

[56] References Cited

U.S. PATENT DOCUMENTS 2,838,607 6/1958 Olson et al. ..... 381/159

FOREIGN PATENT DOCUMENTS 624703 2/1936 Fed. Rep. of Germany .
797083 11/1950 Fed. Rep. of Germany .
1562080 2/1968 Fed. Rep. of Germany .
2550528 11/1975 Fed. Rep. of Germany .
2832612 7/1978 Fed. Rep. of Germany .
2943054 10/1979 Fed. Rep. of Germany .

*Primary Examiner*—L. T. Hix
*Assistant Examiner*—Brian W. Brown
*Attorney, Agent, or Firm*—Sughrue, Mion, Zinn, Macpeak & Seas

[57] ABSTRACT

A speaker system in which a top piece supporting both the magnetic circuit of a speaker and the rear of the vibration plate is connected to a part of the speaker cabinet other than the baffle board at the front of the speaker. Also, an elastic damper is placed between the front of the vibration plate and the baffle board.

4 Claims, 2 Drawing Sheets

SPEAKER SYSTEM WITH INDEPENDENTLY SUPPORTED TOP PLATE

FIELD OF THE INVENTION

The present invention relates to a speaker system which shows improved vibration characteristics.

BACKGROUND OF THE INVENTION

Conventionally, there are known speaker systems as a cone type as shown in FIG. 1 and a dome-type as shown in FIG. 2.

That is, in FIG. 1, a voice coil 3 is fixed on the top of a cone of a vibration plate 2 attached to a frame 1 through an edge of the vibration plate 2. The voice coil 3 generates a driving force in a magnetic gap owing to a sound current flowing through the voice coil 3, so that the vibration plate 2 is vibrated so as to generate a sound pressure.

On the other hand, a magnetic circuit generates magnetic flux in the magnetic gap and is arranged such that a top plate 4, a magnet 5, and a pole yoke 6 are made to adhere with one another by means of a bonding agent. The top plate 4 is fixed to the frame 1 by screws or by means of caulking. The frame 1 is attached at its outer circumference to a baffle board 7 of a speaker cabinet by means of screws.

In the dome-type speaker system shown in FIG. 2, a flange 8 performs the same task as the frame 1 of the cone type speaker system shown in FIG. 1. That is, the flange 8 is equivalent to the frame 1.

However, since the respective conventional speaker system has been arranged in such a manner as described above, the magnetic circuit is vibrated slightly owing to the reaction of a vibrating system constituted by the vibration plate, the voice coil, the edge, and the damper simultaneously with the generation of the sound pressure owing to the driving force generated in the voice coil.

The vibrations are transmitted also to the frame to vibrate the baffle board to radiate unnecessary sound, thereby causing distortion.

SUMMARY OF THE INVENTION

An object of the present invention is to solve the problems in the prior art described above and to provide an improved speaker system in which sound distortion radiated from a baffle board can be reduced.

That is, the speaker system according to the present invention is characterized in that the speaker system is arranged such that a top plate constituting a magnetic circuit is extended so as to be attached to a member other than a baffle board of the cabinet. The invention is further characterized and in that an elastic member is disposed between the baffle board and a frame or a flange for supporting a vibration plate so as to cut off vibration.

DETAILED DESCRIPTION OF THE PREFERRED EMBODIMENTS

Figure 1:
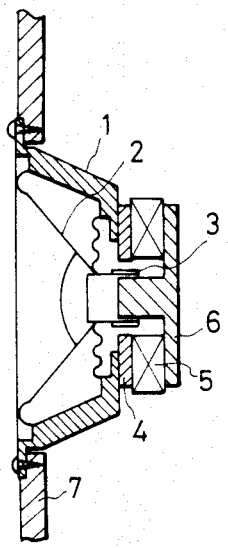
FIG. 1 PRIOR ART
FIGS. 1 and 2 are cross sections respectively showing conventional speaker systems.
Figure 2:
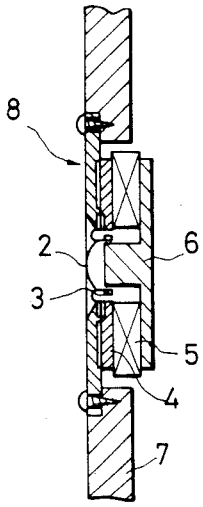
FIG. 2 PRIOR ART

Referring to the drawings, the present invention will be specifically described hereunder.

Figure 3:
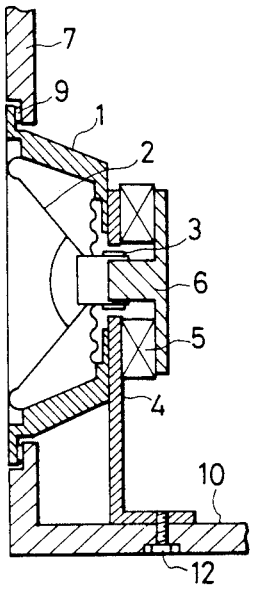
FIG. 3 is a cross section showing an embodiment of the speaker system according to the present invention.

FIG. 3 is a cross section showing an embodiment of the speaker system according to the present invention. In FIG. 3, the reference numerals 1 through 7 designate the same parts as those of the speaker system shown in FIG. 1.

However, the stop plate 4 in FIG. 3 is L-shaped unlike that in FIG. 1, and is fixed to a bottom plate 10 by screws 12. The speaker system in FIG. 3 is further different from that of FIG. 1 in that an elastic member 9 is disposed between the frame 1 and the baffle board 7. The frame 1 is not fixed to the baffle board 7 by screws.

Next, operation of the speaker system of FIG. 3 will now be described. The vibration plate 2 is vibrated owing to a driving force generated at the voice coil 3 to thereby produce a sound pressure. Simultaneously, a magnetic circuit constituted by the top plate 4, the magnet 5 and the pole yoke 6 is moved owing to the reaction of the sound pressure.

Although, the movement of the magnetic circuit is transmitted to the frame 1 fixed on the top plate 4, the movement of the magnetic circuit is never transmitted to the baffle board 7 because the elastic member 9 is interposed and the frame 1 is not fixed to the baffle board 7 by screws according to the present invention.

At this time, although the movement of the magnetic circuit is transmitted to the bottom plate 10 on which the top plate 4 is fixed, the cabinet is generally made of a woody material, so that the bottom plate 10 has a lower propagation velocity of movement and has a larger propagation loss compared to the material, such as iron or aluminum, of the frame 1.

Accordingly, the force for driving the baffle board 7 is smaller than that in the conventional speaker system in which the frame 1 is directly fixed on the baffle board 7. Thus, sound distortion radiated from the baffle board 7 is reduced.

Figure 4:
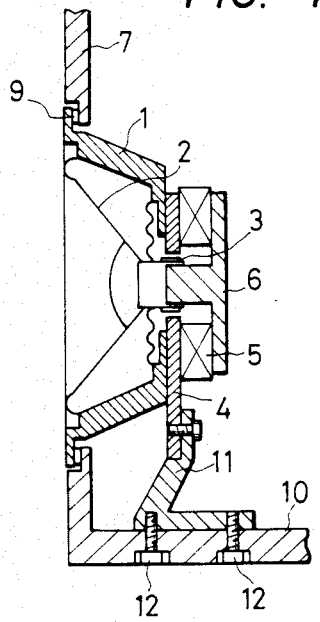
FIGS. 4 and 5 are cross sections respectively showing other embodiments of the speaker system according to the present invention.
Figure 5:
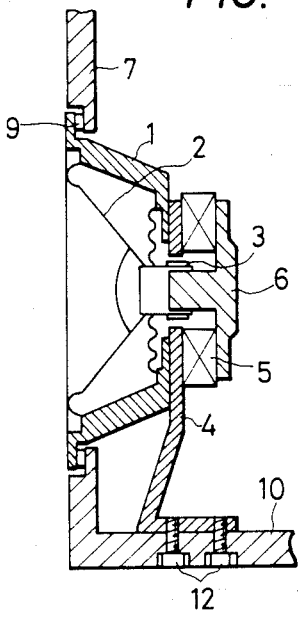

FIGS. 4 and 5 are cross sectional respectively showing other embodiments of the speaker system according to the present invention.

In the speaker system shown in FIG. 4, a top plate 4 extends only in a straight line unlike that in FIG. 3 and is fixed on a bottom plate 10 through a metal mount 11 by screws 12. In this case, if a non-magnetic metal (for example, aluminum, or the like) is used as the metal mount 11, it is possible to obtain the same effect as that in the speaker system in FIG. 3 while keeping the amount of the leakage of magnetic flux substantially at the same level as that of the conventional one.

In the speaker system in FIG. 5, a top plate 4 itself is extended and bent not to be L-shaped as shown in FIG. 3 but to hook-shaped and is fixed to a bottom plate 10 by screws 12. In this case, the rearmost end of the portion of the top plate 4 fixed to the bottom plate 10 is prevented from projecting farther backwards than the back surface of a pole yoke 6. As a result, the speaker system can be assembled more easily.

As described above, according to the present invention, a speaker is attached to a cabinet in such a manner that a top plate is extended so as to be fixed to a surface of a member other than a baffle board and that a frame or a flange is fixed to the baffle board not directly but through an elastic body so as to cut off vibrations. Accordingly, the level for driving the baffle board owing to the movement of the magnetic circuit transmitted through the frame can be extremely reduced to thereby reduce the extraneous generation of a sound pressure, that is, distortion from the baffle board.

Figure 6:
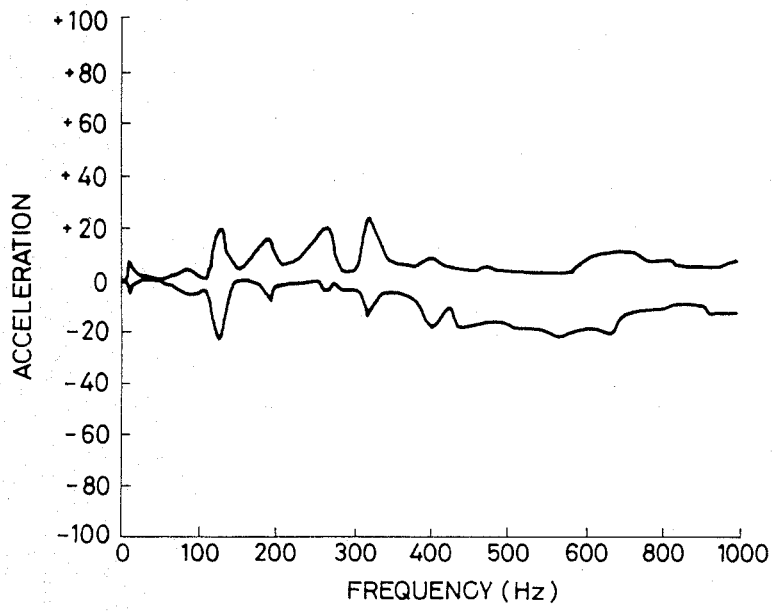
FIG. 6 is a diagram showing the frequency characteristic of vibrations in a baffle board of the speaker system in the embodiment according to the present invention.
Figure 7:
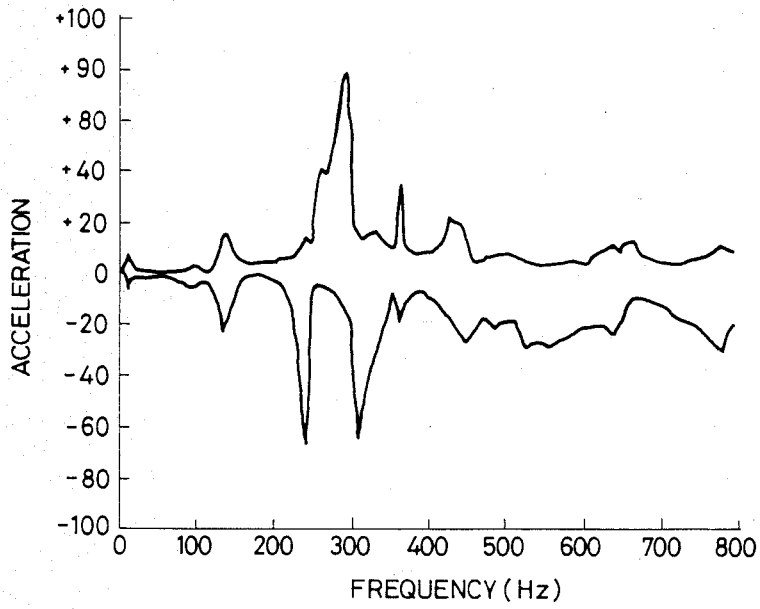
FIG. 7 is a diagram showing the frequency characteristic of the vibrations in the conventional speaker system.

FIG. 6 is a diagram showing the frequency characteristic of vibrations of the baffle board in the embodiment of the speaker system according to the present invention. FIG. 7 is a diagram of the frequency characteristic vibration of the baffle board in the conventional speaker system.

As is apparent from FIGS. 6 and 7, in the speaker system according to the present invention, the vibration level of the baffle board is reduced from that of the conventional one, and especially the effect of reduction in vibrations is remarkable in a frequency band of 200–500 HZ.

What is claimed is:

1. A speaker system, comprising:

a cabinet having a baffle board facing a principal sound propagation direction and other wall members;

a voice coil passing a sound current therethrough;

a vibration plate to which said voice coil is attached;

a magnetic circuit interacting with said voice coil and including a top plate supporting said magnetic circuit and extending away from said magnetic circuit and connected to at least one of said other wall members but not to said baffle board;

a frame for supporting said vibration plate, said frame being fixed to said top plate; and an elastic member disposed between said baffle board and said frame.

2. A speaker system as recited in claim 1, wherein said top plate is connected to a non-magnetic member connected to said one other wall member.

3. A speaker system as recited in claim 2, wherein said at least one other wall member faces a direction other than said principal propagation direction.

4. A speaker system as recited in claim 1, wherein said frame and said baffle board are fixed to one another through said elastic member.

* * * * *